US010448696B2

(12) United States Patent
Sutton

(10) Patent No.: US 10,448,696 B2
(45) Date of Patent: Oct. 22, 2019

(54) DECORATIVE SLIPPER WITH CHANGEABLE ANIMAL FACES

(71) Applicant: Jay At Play International Hong Kong Limited, Kowloon (HK)

(72) Inventor: Joseph A. Sutton, Delray Beach, FL (US)

(73) Assignee: JAY AT PLAY INTERNATIONAL HONG KONG LIMITED, Kowloon (HK)

( * ) Notice: Subject to any disclaimer, the term of this patent is extended or adjusted under 35 U.S.C. 154(b) by 45 days.

(21) Appl. No.: 15/368,796

(22) Filed: Dec. 5, 2016

(65) Prior Publication Data

US 2018/0153251 A1 Jun. 7, 2018

(51) Int. Cl.
*A43B 3/24* (2006.01)
*A43B 3/00* (2006.01)
(Continued)

(52) U.S. Cl.
CPC ..... *A43B 3/242* (2013.01); *A43B 3/0036* (2013.01); *A43B 3/101* (2013.01); *A43B 3/12* (2013.01)

(58) Field of Classification Search
CPC ..... A43B 3/242; A43B 3/0036; A43B 3/101; A43B 3/108
(Continued)

(56) References Cited

U.S. PATENT DOCUMENTS

D39,135 S 2/1908 Keilman
1,138,412 A 5/1915 Radick
(Continued)

FOREIGN PATENT DOCUMENTS

GB 1112375 5/1968
GB 2458838 10/2009
(Continued)

OTHER PUBLICATIONS

Pufferbelly Toys, "Kinder Surprise Toys Natoons Series Animal Shifters 2014-2015-SurpriseEggsSHOW" available online as early as Mar. 5, 2017 (http://www.pufferbellytoys.com/kinder-surprise-toys-natoons-series-animal-shifters-2014-2015-surpriseeggs show/).
(Continued)

*Primary Examiner* — Anne M Kozak
(74) *Attorney, Agent, or Firm* — Michael Best & Friedrich LLP

(57) ABSTRACT

The decorative slipper 10 includes a pocket opening 70 for reception of a person's foot therein. Pocket 70 is comprised of two toe receiving sections, a first section 70*a* and a second section 70*b*. The flap 20 is movable to the first position 50 wherein the flap 20 covers the first face 12 and body of the slipper while exposing the second face 16, and the flap opening 40 is aligned with pocket opening 70. In order to align the wearer's foot with the second face 16, the wearer places his toe section in the second section 70*b* of pocket 70. The flap 20 is also movable to a second position 60 wherein, the flap 20 covers the second face 16 and body of the slipper while exposing the first face 12, and the flap opening 40 is aligned with pocket opening 70. In order to align the wearer's foot with the first face 12, the wearer places his toe section in the first section 70*a* of pocket 70. In this manner, the pocket 70 allows the wearer to use the same pocket 70 to walk in two different directions depending on whether animal face 12 is uncovered or animal face 16 is uncovered by movable flap 20.

17 Claims, 5 Drawing Sheets

(51) Int. Cl.
*A43B 3/10* (2006.01)
*A43B 3/12* (2006.01)

(58) Field of Classification Search
USPC ..... 36/100
See application file for complete search history.

(56) References Cited

U.S. PATENT DOCUMENTS 1,148,540 A 8/1915 Sander
1,322,713 A 11/1919 Marshall
1,396,766 A 11/1921 McClelland
1,966,986 A 7/1934 Martin
1,981,813 A 11/1934 Schuster
2,195,127 A 3/1940 Brucker
D123,710 S 11/1940 Berenzweig
2,274,303 A 2/1942 Ornstein
2,314,223 A 3/1943 Lane
D135,970 S 7/1943 Katz
D137,682 S 4/1944 Katz
D141,120 S 5/1945 Katz
D141,346 S 5/1945 Katz
D142,483 S 5/1945 Katz
D146,032 S 12/1946 Katz
D147,666 S 10/1947 Katz
D155,050 S 8/1949 Vaisey
D179,740 S 2/1957 Nagel
3,023,420 A * 3/1962 Tann ..... A41B 11/001 2/239
3,226,849 A * 1/1966 Rosen ..... A43B 3/00 2/239
3,551,963 A 1/1971 Mosher, Jr. et al.
3,737,196 A 6/1973 Bodor
3,831,316 A 8/1974 Weistrop
3,851,419 A 12/1974 Kaelin
4,107,873 A 8/1978 Bauer
4,198,733 A 4/1980 Ferguson et al.
4,268,918 A 5/1981 Lee
4,336,665 A 6/1982 Moreau
D267,313 S 12/1982 Northcutt, III
D269,862 S 7/1983 Meyer
4,568,304 A 2/1986 Santa Maria
4,580,992 A 4/1986 McKay
4,695,264 A 9/1987 McLeod, Jr.
4,842,565 A 6/1989 VonPhilp, Sr.
4,921,459 A 5/1990 Cook et al.
5,058,293 A * 10/1991 Villar ..... A43B 3/00 36/1
5,080,518 A 1/1992 Mason
5,090,935 A 2/1992 Monson
5,149,289 A 9/1992 Edwards et al.
5,162,013 A 11/1992 von Mohr
5,222,988 A 6/1993 Riley
5,348,510 A 9/1994 DuPont et al.
5,459,948 A * 10/1995 Aveni ..... A43B 3/24 36/100
5,615,496 A * 4/1997 Sharpstein ..... A43B 3/106 36/11.5
5,649,848 A 7/1997 Clark
D392,916 S * 3/1998 Sutton ..... D11/157
5,737,853 A * 4/1998 Smejkal ..... A43B 3/101 36/11.5
6,174,216 B1 1/2001 Chianese
6,189,240 B1 * 2/2001 Cowgill ..... A43B 3/0078 36/1
6,276,074 B1 * 8/2001 Martin ..... A43B 3/0078 36/1
6,315,571 B1 * 11/2001 Lee ..... A43B 3/00 362/103
6,446,361 B1 * 9/2002 Chun ..... A43B 3/0078 36/100
6,769,204 B1 * 8/2004 Phillips ..... A43B 1/0081 36/100
6,792,697 B2 * 9/2004 Wright ..... A43B 1/10 12/142 S
D514,285 S * 2/2006 Jarmon Mouchi ..... D2/946
7,076,824 B2 * 7/2006 Steidle ..... A43B 3/0078 12/142 A
7,698,834 B1 * 4/2010 Courville ..... A43B 3/24 36/100
8,266,828 B2 * 9/2012 Strong ..... A41D 27/08 36/112
D675,407 S * 2/2013 Klinge ..... D2/898
8,375,469 B2 2/2013 Duwyn-Zylstra
8,506,344 B2 8/2013 Chan et al.
8,959,795 B2 * 2/2015 Cristea ..... A43B 3/102 36/100
D742,104 S * 11/2015 Sutton ..... D2/899
9,873,059 B1 * 1/2018 Sutton ..... A63H 33/003
2004/0026468 A1 2/2004 Lawrence
2005/0039345 A1 2/2005 Jones et al.
2006/0201034 A1 * 9/2006 Ambrogio ..... A43B 3/24 36/101
2007/0079528 A1 * 4/2007 Wakefield ..... A43B 3/0078 36/112
2008/0155788 A1 7/2008 Wilcox
2010/0181032 A1 7/2010 Bennett et al.
2011/0277344 A1 * 11/2011 Berg ..... A43B 3/101 36/11.5
2012/0108137 A1 * 5/2012 Sutton ..... A63H 3/005 446/73
2013/0019380 A1 1/2013 Sitt et al.
2013/0180135 A1 * 7/2013 Kelley ..... A43B 1/0027 36/136
2014/0189933 A1 7/2014 Toronto
2014/0196318 A1 * 7/2014 Verheem ..... A43B 1/0081 36/100
2017/0136375 A1 5/2017 Narayanan et al.

FOREIGN PATENT DOCUMENTS

WO 93/05857 4/1993
WO 00/64551 11/2000
WO 2006/100419 9/2006

OTHER PUBLICATIONS

Wanelo, "Topsy Turvy Dolls" available online at least as early as Mar. 5, 2017 (https://wanelo.co/shop/topsy-turvy-dolls).
As Seen on TV, "Pop Out Pets Dogs" available online at least as early as Sep. 5, 2015 (http://www.asseenontv.com/pop-out-pets-dogs/detail.php?p=863930).

* cited by examiner

DECORATIVE SLIPPER WITH CHANGEABLE ANIMAL FACES

FIELD OF THE INVENTION

The present invention relates to a decorative slipper with changeable animal faces embodying a caricature of the head and body of an animal, wherein a movable flap having a different animal face on each side changes the appearance and face of the slipper.

BACKGROUND OF THE INVENTION

The prior art discloses decorative or novelty slipper footwear that simulate the shape of animals, dolls, or toys. However, none of these known decorative slippers or footwear teach or disclose a decorative slipper embodying a caricature of the head and body of an animal, wherein a movable flap is provided having a different face on each side which changes the face and appearance of the slipper. More specifically, the prior art does not disclose a decorative slipper for wearing on a person's foot, wherein the upper part of the slipper forms a caricature of a body and a head of an animal, and wherein the body includes a movable flap having a different face on each side of the movable flap to change the face and appearance of the animal on the slipper body.

DESCRIPTION OF THE PRIOR ART

Novelty footwear is known in the art. For example, U.S. Pat. No. Des. 49,946 provides an ornamental slipper having a head of a rabbit formed on a toe portion and a tail-like member on a heel portion of the slipper to give the appearance that the wearer's foot is a rabbit. Another example is U.S. Pat. No. Des. 327,361 wherein a child's bootie is formed in the shape of a dog, bear or rabbit head. Still another example is U.S. Pat. No. 5,085,294 which provides an article of footwear having an animated face with eyes which move in response to weight transfer while walking in the footwear in order to give the appearance of the registration of pain with each step. Yet, another example is U.S. Pat. No. 6,189,240 which provides shoes that are constructed to simulate that each foot is being placed into the articulating mouth of an animal's head.

In addition, U.S. Pub. Pat. No. 2014/0298684 to Young discloses reversible footwear allows a user to quickly reverse the interior and exterior portions by essentially turning the footwear inside out.

Furthermore, U.S. Pat. No. 6,446,361 to Chun discloses a slipper having a sole and a foot covering that transforms into a toy play character by coupling the sole to the foot covering.

However, none of the following prior art references teach or disclose the basic structure of a decorative slipper that is shaped to simulate the body and head of an animal wherein a movable flap having a different face on each side of the flap changes the face and appearance of the slipper.

OBJECTS OF THE INVENTION

An object of the invention is to provide a decorative slipper, wherein a movable flap having a different face on each side changes the face and appearance of the slipper.

Another object of this invention is to provide a decorative slipper to be worn and used on the foot and also as a toy, plush or stuffed animal. This combination of slipper and plush toy produces an article practical and useful as either a slipper or plush animal and having appeal not only as an attractive foot covering but also as an amusing toy.

Another object of this invention is to provide a decorative slipper of the foregoing character which is flexible, which is simple and inexpensive to manufacture, which may be readily packed in a minimum space, and which is light in weight.

Another object of this invention is to provide a slipper body having a first face with a first animal appearance and, on the other end, a second face having a second animal appearance.

Another object of this invention is to provide a movable flap connected to the body of the slipper, which has a first cover surface with a first animal appearance, and a second cover surface with a second animal appearance.

Another object of this invention is to provide a movable flap having an opening formed therein for receiving the wearer's foot.

Another object of this invention is to provide a movable flap opening which is aligned with a foot receiving pocket in the body of the slipper.

SUMMARY OF THE INVENTION

A decorative slipper is provided which has the appearance of a first face connected to a body of an animal and a second face connected to the other end of the body. The body has a pocket for receiving a person's foot therein. In addition, a movable flap is connected to the exterior surface of the body near its center. One side of the flap has a first cover surface, and the other side of the flap has a second cover surface face, and the movable flap has an opening formed therein, that aligns with the pocket formed in the body. The flap is movable to a first position wherein it covers the first face while exposing the second face to viewing by the user and others. Further, the flap is movable to a second position wherein it covers the second face while exposing the first face to viewing by the user and others, thereby changing the appearance of the body of the slipper, so it presents the appearance of two different animals.

DETAILED DESCRIPTION OF THE PREFERRED EMBODIMENT

Figure 1:
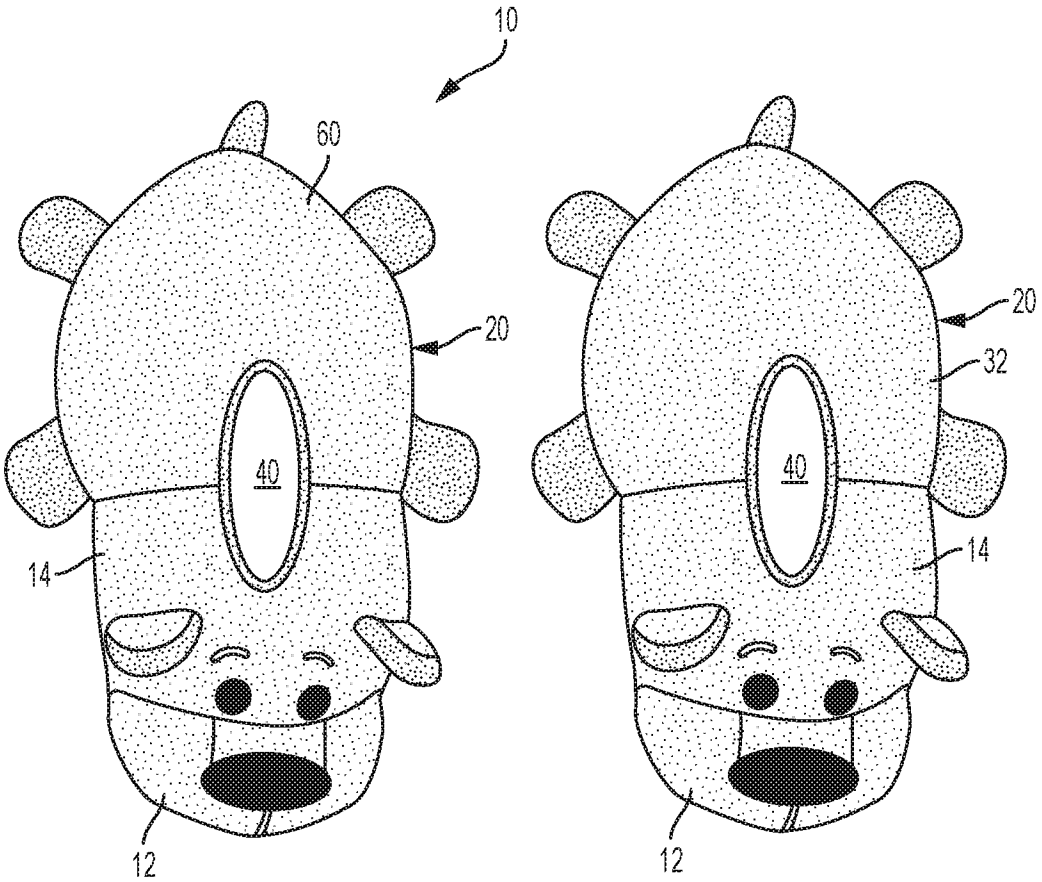
FIG. 1 is a top view of the decorative slipper showing a first animal face.
Figure 2:
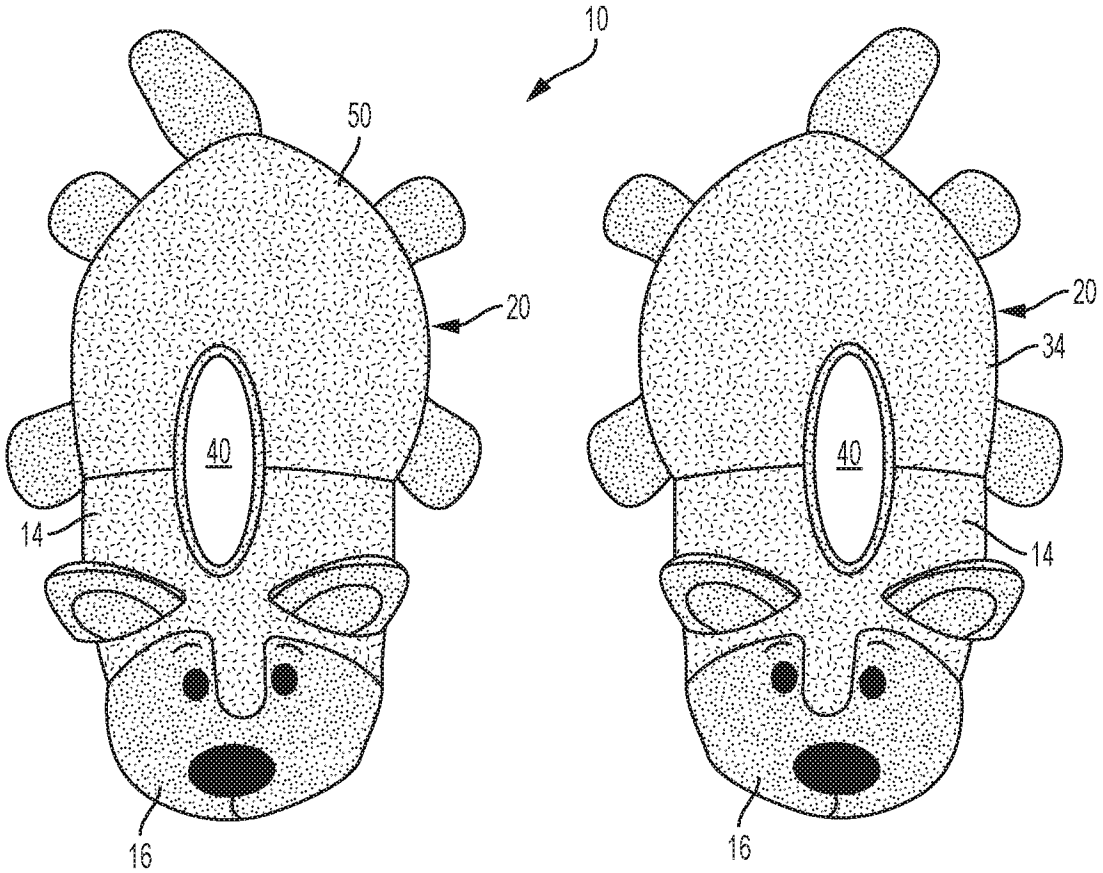
FIG. 2 is a top view of the decorative slipper showing a second animal face on the opposite end.
Figure 3:
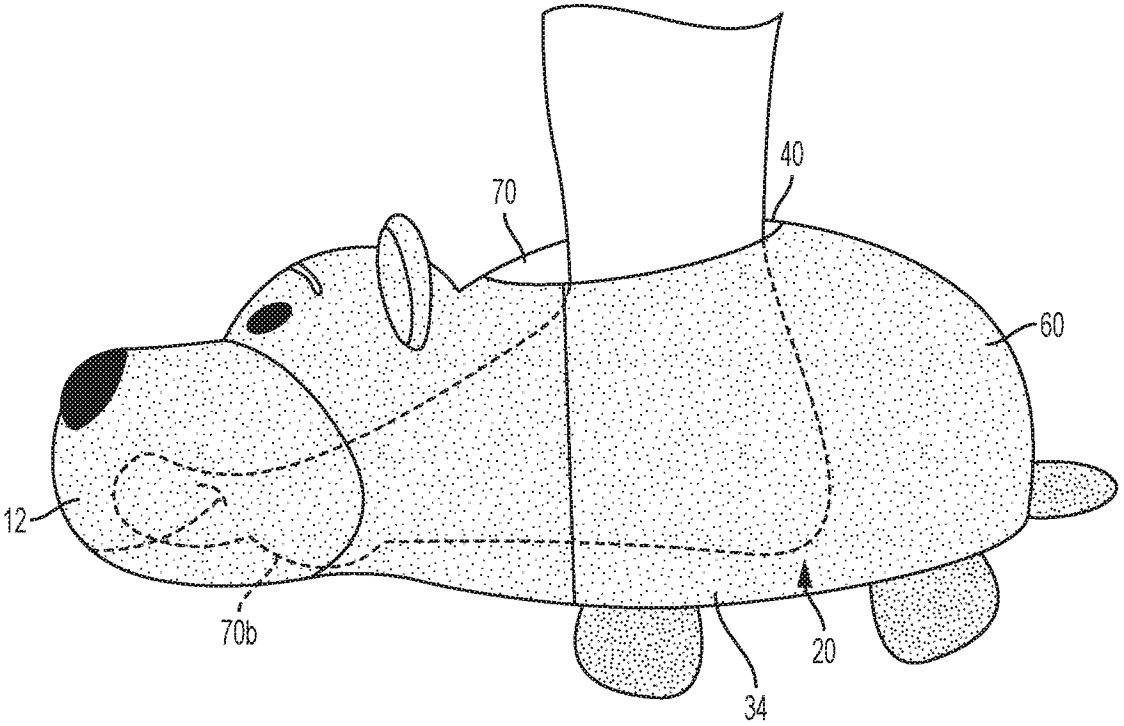
FIG. 3 is a side perspective view showing the foot and toes aligned with the first animal face.
Figure 4:
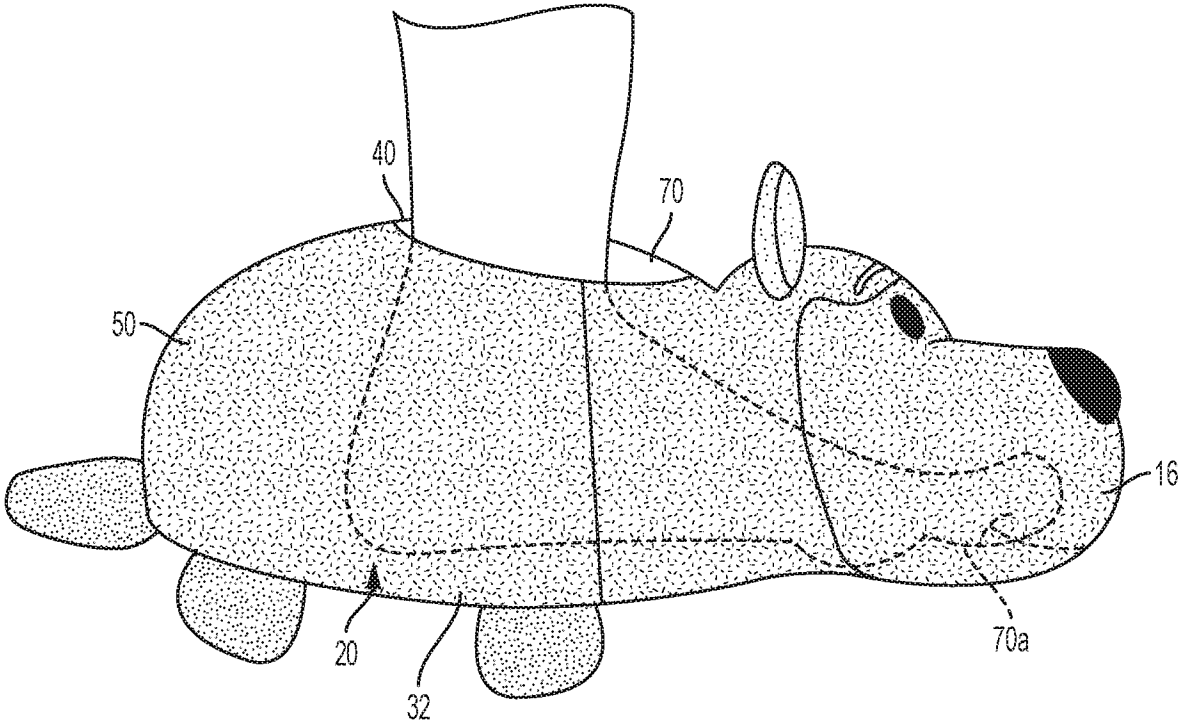
FIG. 4 is a side perspective view showing the foot and toes aligned with the second animal face.
Figure 5:
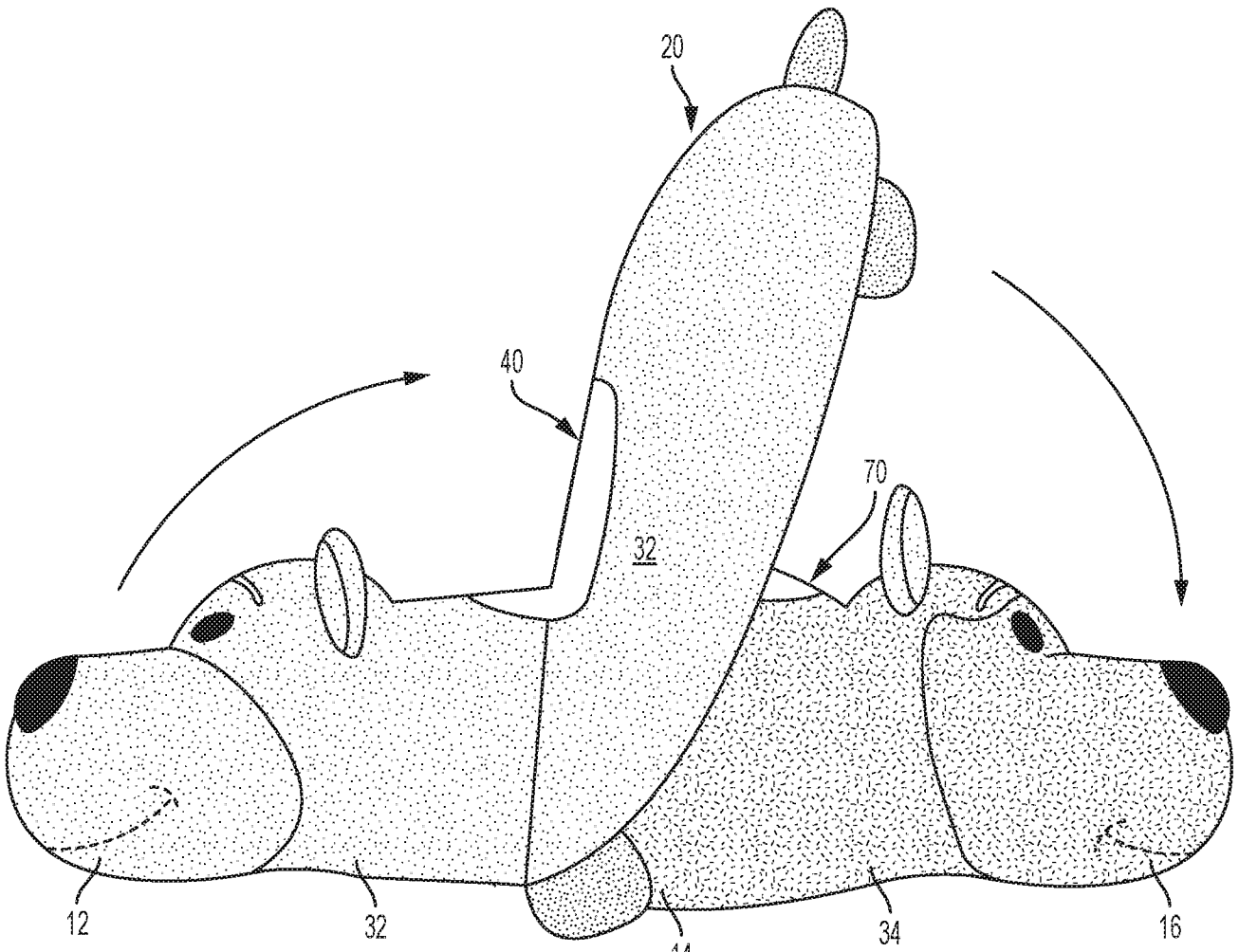
FIG. 5 is a perspective view showing the movable flap opening being aligned with the foot opening.

A decorative slipper 10 is provided which has the appearance of a first animal face 12 connected to a body 14 of an animal and a second animal face 16 connected to the other end of the body 14. In addition, a movable flap 20 is connected to the exterior surface of the body 14 at its center. One side of the flap 20 has a first animal cover surface 32, and the other side of the flap 20 has a second animal cover surface 34. Also, the movable flap 20 has an opening 40 formed therein for the foot to pass through. The flap 20 is movable to a first position 50 wherein it covers the first face 12 while exposing the second face 16 to viewing by the user and others. Further, the flap 20 is movable to a second position 60 wherein it covers the second face 16 while exposing the first face 12 to viewing by the user and others. In this manner, the appearance of the body and face of the slipper 10 is changed, so that the slipper presents the appearance of two different animals.

The decorative slipper 10 also includes a pocket 70 for reception of a person's foot therein. Pocket 70 is comprised of two toe receiving sections, a first toe section 70*a* for receiving the toe section of the foot when the wearer has aligned his foot with the first animal face 16, and a second toe receiving section 70*b* for receiving the toe section of the foot when the wearer has aligned his foot with the first animal face 12.

The flap 20 is movable to the first position 50, wherein the first animal cover surface 32 of flap 20 covers the first face 12 and body of the slipper, while exposing the second face 16, and the flap opening 40 is aligned with pocket 70. In this manner, the first toe receiving section 70*a* of pocket 70 receives the toe section of the wearer, when the person's foot is aligned with the second face 16 of the slipper.

The flap 20 is also movable to a second position 60 wherein the second animal cover surface 34 of flap 20 covers the second face 16 and body of the slipper, while exposing the first face 12, and the flap opening 40 is aligned with pocket opening 70. In this manner, the second toe receiving section 70*b* of pocket 70 receives the toe section of the wearer, when the person's foot is aligned with the first face 12 of the slipper.

In this manner, the pocket 70 allows the wearer to use the same pocket 70 to walk in two different directions depending on whether animal face 12 is uncovered or animal face 16 is uncovered by movable flap 20.

The body of the decorative slipper can also have arms, legs, or a tail. Also, the flap 20 can have arms, legs, or a tail attached to it. Also, the faces of the decorative slipper have eyes, ears, a nose, a mouth, teeth, or a tongue.

Furthermore, the decorative slipper can simulate the appearance of animals selected from a group comprising: a dog, a wolf, a bear, a cow, a cat, a mouse, a monkey, a frog, unicorn, horse, dragon, lizard, tiger, giraffe, elephant, hippopotamus, hedgehog, turtle, or a rabbit, etc. Also, it is conceivable that the wearer of a pair of decorative slipper could wear one of the decorative slippers wherein one of the decorative slippers include a first animal face and wherein the other decorative slipper can include a second animal face.

Finally, the bottom of the decorative slipper may have multiple slip-resistant devices, including for example rubber studs.

It should be understood that the term "decorative slipper" as used throughout this specification should include a slipper, a slipper sock, a sock, a shoe, a sandal, and a boot, generally.

In the specification the terms "comprise, comprises, comprised and comprising" or any variation thereof and the terms "include, includes, included and including" or any variation thereof are considered to be totally interchangeable and they should all be afforded the widest possible interpretation.

OPERATION OF THE PRESENT INVENTION

The decorative slipper 10 includes a pocket opening 70 for reception of a person's foot therein. Pocket 70 is comprised of two toe receiving sections, a first section 70*a* and a second section 70*b*. The flap 20 is movable to the first position 50 wherein the flap 20 covers the first face 12 and body of the slipper while exposing the second face 16, and the flap opening 40 is aligned with pocket opening 70. In order to align the wearer's foot with the second face 16, the wearer places his toe section in the second section 70*b* of pocket 70.

The flap 20 is also movable to a second position 60 wherein, the flap 20 covers the second face 16 and body of the slipper while exposing the first face 12, and the flap opening 40 is aligned with pocket opening 70. In order to align the wearer's foot with the first face 12, the wearer places his toe section in the first section 70*a* of pocket 70.

In this manner, the pocket 70 allows the wearer to use the same pocket 70 to walk in two different directions depending on whether animal face 12 is uncovered or animal face 16 is uncovered by movable flap 20.

ADVANTAGES OF THE PRESENT INVENTION

It is an advantage of the present invention is to provide a decorative slipper, wherein a movable flap having a different face on each side changes the face and appearance of the slipper.

Another advantage of this invention is to provide a decorative slipper is to provide a decorated slipper to be worn and used on the foot and also as a toy, plush or stuffed animal. This combination of slipper and plush toy produces an article practical and useful as either a slipper or plush animal and having appeal not only as an attractive foot covering but also as an amusing toy.

Another advantage of this invention is to provide a decorative slipper of the foregoing character which is flexible, which is simple and inexpensive to manufacture, which may be readily packed in a minimum space, and which is light in weight.

Another advantage of this invention is to provide a slipper body having a first face with a first animal appearance and, on the other end, a second face having a second animal appearance.

Another advantage of this invention is to provide a movable flap connected to the body of the slipper, which has a first cover surface with a first animal appearance, and a second cover surface with a second animal appearance.

Another advantage of this invention is to provide a movable flap having an opening formed therein for receiving the wearer's foot.

Another advantage of this invention is to provide a movable flap opening which is aligned with a foot receiving pocket in the body of the slipper.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An article of footwear having two different configurations, the article of footwear comprising: a body having a first end and an opposite second end and a pocket extending between the first end and the second end, the pocket having an opening, the opening configured to receive a foot of a wearer, wherein the pocket is configured such that the foot of the wearer can alternatively be placed in the pocket with toes of the foot adjacent either the first end or the second end of the article of footwear; and a flap coupled to the body and rotatable between a first position, in which a first surface of the flap faces outward and is positioned to be the outermost surface visible to the wearer when worn, and a second position, in which a second opposite surface of the flap faces outward and is positioned to be the outermost surface visible to the wearer when worn, wherein when the flap is in the first position, the body and the flap define a first configuration, and when the flap is in the second position, the body and the flap define a second configuration different from the first configuration, and wherein the flap has a flap opening that is aligned with the opening of the pocket when the flap is in either the first position or the second position, wherein the flap opening is configured such that the wearer can place their foot through the flap opening and the opening of the pocket when the flap is in either the first position or the second position.

2. The article of footwear of claim 1, wherein the first surface of the flap defines a first animal body portion of the first configuration, and the second opposite surface of the flap defines a second animal body portion of the second configuration.

3. The article of footwear of claim 2, wherein the first end of the body is beneath the flap when the flap is in the second position and the second end of the body is beneath the flap when the flap is in the first position, wherein the second end of the body includes a first head portion and the first end of the body includes a second head portion, wherein when the flap is in the first position the first end of the body and the first surface of the flap face outward and are positioned to be an outermost portion visible to the wearer when worn to represent the first configuration and when the flap is in the second position the second end of the body and the second surface of the flap face outward and are positioned to be an outermost portion visible to the wearer when worn to represent the second configuration.

4. The article of footwear of claim 1, wherein the first configuration represents a first image and the second configuration represents a second image that is different from the first image.

5. The article of footwear of claim 1, wherein the flap is coupled to the body at a midpoint between the first end and the second end of the body.

6. An article of footwear comprising: a body with a first portion having a first surface, the first portion of the body extending from a first end of the body to a center of the body, a second portion having a second surface, the second portion of the body extending from a second end of the body opposite the first end to the center of the body, and a pocket having an opening, the opening configured to receive a foot of a wearer; and a flap coupled to the body between the first portion of the body and the second portion of the body, wherein the flap has a first surface and an opposite second surface, wherein the flap is movable between a first position and a second position, wherein when the flap is in the first position the first surface of the flap and the first surface of the first portion of the body face outward and are positioned to be an outermost portion visible to the wearer when worn and the second surface of the second portion of the body is covered by the flap, wherein when the flap is in the second position the second surface of the flap and the second surface of the second portion of the body face outward and are positioned to be an outermost portion visible to the wearer when worn and the first surface of the first portion of the body is covered by the flap, and wherein the flap includes a flap opening that aligns with the opening of the pocket to receive the foot of the wearer when the flap is in either the first position or the second position.

7. The article of footwear of claim 6, wherein the pocket is configured such that the foot of the wearer can alternatively be placed in the pocket with toes of the wearer adjacent either the first end of the body or the second end of the body.

8. The article of footwear of claim 7, wherein the flap is movable in a first direction such that the first surface of the first portion of the body faces outward and is positioned to be the outermost surface visible to the wearer when worn and in a second direction opposite to the first direction such that the second surface of the second portion of the body faces outward and is positioned to be the outermost surface visible to the wearer when worn.

9. The article of footwear of claim 6, wherein the first direction is a first rotational direction and the second direction is a second rotational direction.

10. The article of footwear of claim 6, wherein the first surface of the first portion of the body and the first surface of the flap define a first configuration and the second surface of the second portion of the body and the second surface of the flap define a second configuration that is different from the first configuration.

11. An article of footwear comprising: a body with a pocket having an opening, the opening configured to receive a foot of a wearer; a flap coupled to the body along a line transverse to a length of the body, the flap having a first surface defining a portion of a first configuration, the flap also having a second surface opposite the first surface and defining a portion of a second configuration, the second configuration being different from the first configuration; a first surface of the body that defines a portion of the first configuration, wherein the first surface of the body is beneath the flap when the flap is in a second position and faces outward and is positioned to be the outermost surface visible to the wearer when worn when the flap is in a first position; and a second surface of the body that defines a portion of the second configuration, wherein the second surface of the body is beneath the flap when the flap is in the first position and faces outward and is positioned to be the outermost surface visible to the wearer when worn when the flap is in the second position, wherein the flap is movable from the first position in which the first surface of the flap and the first surface of the body both face outward and are positioned to be an outermost portion visible to the wearer when worn and the second surface of the flap and the second surface of the body are covered such that they are hidden from a view of the wearer when worn, to the second position in which the second surface of the flap and the second surface of the body both face outward and are positioned to be an outermost portion visible to the wearer when worn and the first surface of the flap and the first surface of the body are covered such that they are hidden from a view of the wearer when worn; wherein a portion of the first surface of the body represents at least a portion of a first head of a first animal and a portion of the second surface of the body represents at least a portion of a second head of a second animal that is different from the first head of the first animal.

12. The article of footwear of claim 11, wherein the first surface of the flap represents at least a portion of a first animal body of the first animal and the second surface of the flap represents at least a portion of a second animal body of the second animal that is different from the first animal body of the first animal.

13. The article of footwear of claim 11, wherein the body has a first end and an opposite second end and the pocket is configured such that the foot of the wearer can alternatively be placed in the pocket with toes of the wearer adjacent either the first end of the body or the second end of the body.

14. The article of footwear of claim 11, wherein the flap is coupled to the body at a midpoint of the body.

15. The article of footwear of claim 11, wherein the flap includes a flap opening that aligns with the opening of the pocket to receive the foot of the wearer when the flap is in either the first position or the second position.

16. The article of footwear of claim 11, wherein the flap moves in a first direction from the first position to the second position and in a second direction opposite to the first direction from the second position to the first position.

17. The article of footwear of claim 16, wherein the first direction is a first rotational direction, and the second direction is a second rotational direction.

* * * * *